United States Patent [19]

Sumi

[11] Patent Number: 4,655,493

[45] Date of Patent: Apr. 7, 1987

[54] SHIELD TUNNELING MACHINE

[75] Inventor: Toshio Sumi, Kodaira, Japan

[73] Assignee: Kabushiki Kaisha Iseki Kaihatsu Koki, Tokyo, Japan

[21] Appl. No.: 810,062

[22] Filed: Dec. 17, 1985

[30] Foreign Application Priority Data

Jan. 29, 1985 [JP] Japan ..... 60-13500

[51] Int. Cl.[4] ..... E21D 9/08

[52] U.S. Cl. ..... 299/33; 299/31; 405/143

[58] Field of Search ..... 299/31, 33, 55; 405/141–143

[56] References Cited

U.S. PATENT DOCUMENTS

| | | | |
|---|---|---|---|
| 3,630,574 | 12/1971 | Cox et al. | 299/31 |
| 3,967,463 | 7/1976 | Grandori | 299/33 X |
| 4,095,436 | 6/1978 | Heitkamp et al. | 405/142 |
| 4,398,845 | 8/1983 | Stuckmann et al. | 405/141 X |
| 4,406,498 | 9/1983 | Akesaka | 299/18 X |
| 4,420,188 | 12/1983 | Robbins et al. | 299/31 |
| 4,508,390 | 4/1985 | Bessol | 405/143 X |

*Primary Examiner*—Stephen J. Novosad
*Assistant Examiner*—Michael A. Goodwin
*Attorney, Agent, or Firm*—Kane, Dalsimer, Kane, Sullivan and Kurucz

[57] ABSTRACT

A shield tunneling machine comprises a shield body provided with a tubular head portion and a tubular tail portion disposed behind the head portion. The head portion and tail portion are interconnected by a plurality of thrusting jacks for moving both portions to and away from each other. In the shield body are arranged a cutter head for excavating the face, a mechanism for rotating the cutter head and a plurality of position-maintaining mechanisms making the natural ground a reaction body to advance the shield body and having press bodies capable of projecting outward of the shield body. The machine, during the excavation has the head portion advanced relative to the tail portion by the thrusting jack and the tail portion next attracted to the head portion by the thrusting jack.

4 Claims, 7 Drawing Figures

SHIELD TUNNELING MACHINE

BACKGROUND OF THE INVENTION

1. Field of the Invention

This invention relates to a shield tunneling machine using a tubular shield body.

2. Description of the Prior Art

Since a shield tunneling machine using a tubular shield body uses segments as reaction bodies when advancing the shield body, it cannot be applied to the excavation not using segments like that of bedrock layer. Further, said segments were sometimes subjected to an unreasonable force to be broken down in the advancing of the shield body.

SUMMARY OF THE INVENTION

An object of the present invention is to provide a shield tunneling machine which can be used for either of the excavation using segments and that not using segments and prevent the segments from an unreasonable force and thus breakage.

The shield tunneling machine according to the present invention comprises a shield body provided with a tubular head portion and a tubular tail portion disposed behind the head portion, a plurality of thrusting jacks for interconnecting said head portion and tail portion and moving the head and tail portions to or away from each other, a cutter head disposed in the front portion of said shield body, a rotary mechanism for rotating the cutter head and a plurality of position-maintaining mechanisms disposed in the shield body and having press bodies capable of projecting outward of the shield body.

In the tunneling machine according to the present invention, the shield body is provided with the head portion and the tail portion and which are interconnected by a plurality of thrusting jacks for moving the head and tail portions to and away from each other. The position maintaining mechanism having press bodies capable of projecting outward of the shield body is provided in the shield body so that the press bodies of said position maintaining mechanism can be projected to make the natural ground around the shield body a reaction body. Thus, the tunneling machine can be used for either of the excavation using the segments and the excavation not using same and the segments are not subjected to any unreasonable force causing damages thereof.

The other objects and features of the present invention will become apparent from the following description of preferred embodiment of the invention with reference to the accompanying drawings.

DESCRIPTION OF THE PREFERRED EMBODIMENT

Figure 1:
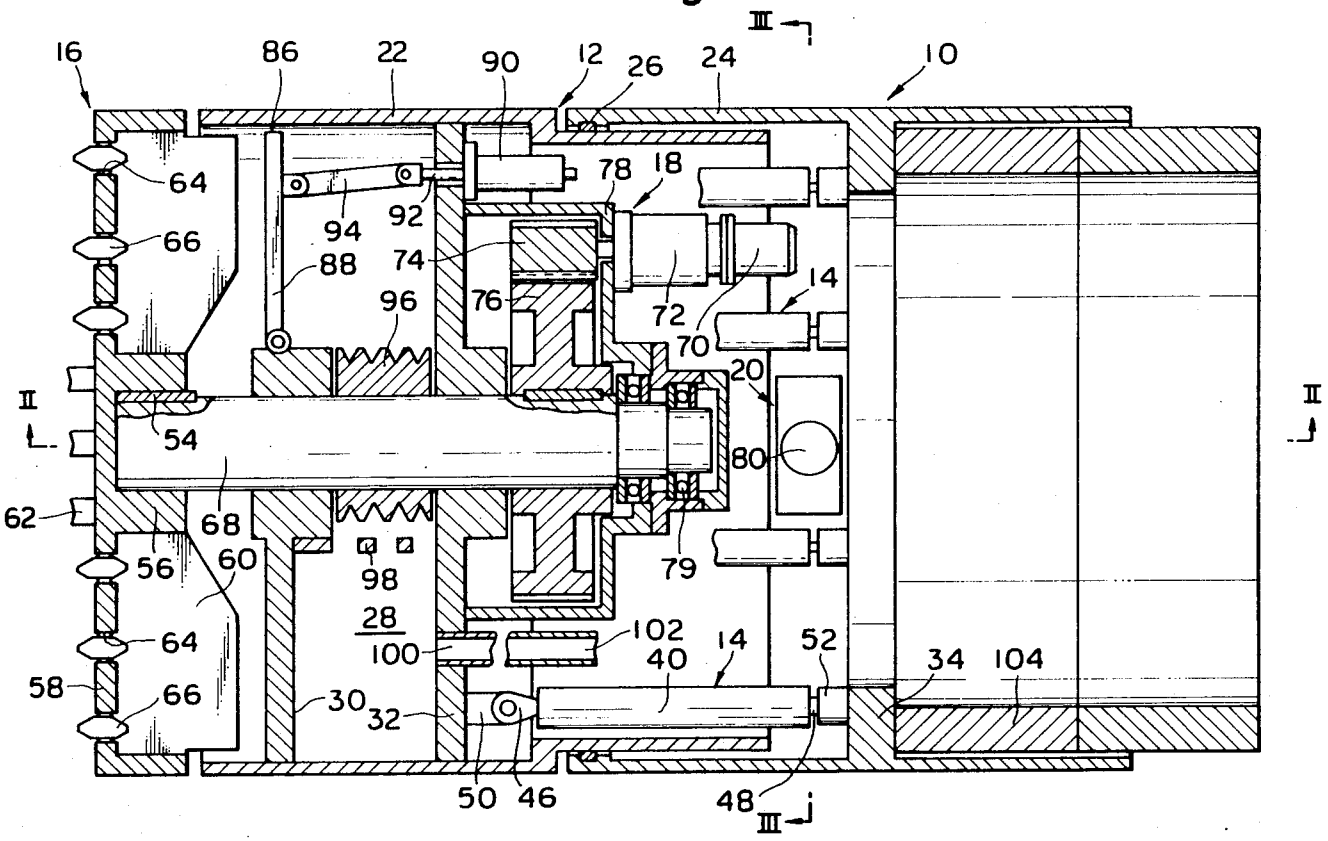
FIG. 1 is a longitudinal sectional view showing an embodiment of a shield tunneling machine according to the present invention.
Figure 2:
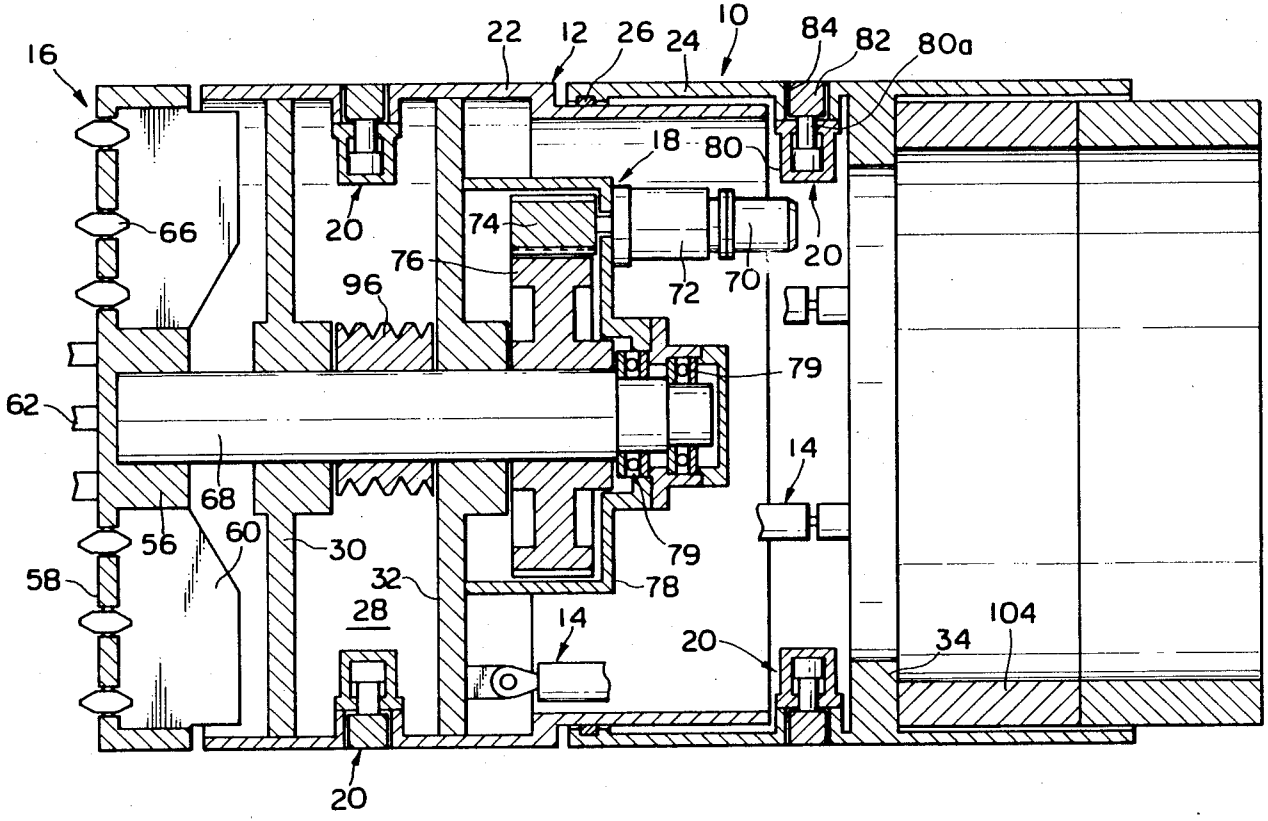
FIG. 2 is a sectional view taken along the line II—II in FIG. 1.

A shield tunneling machine is designated by reference numeral 10 in FIGS. 1 and 2. The shield tunneling machine 10 comprises a tubular shield body 12, a plurality of thrusting jacks 14 disposed in the shield body, a cutter head 16 disposed in the front portion of said shield body 12, a rotary mechanism 18 for rotating the cutter head and a plurality of position-maintaining mechanisms 20 disposed in the shield body 12.

The shield body 12 is provided with a tubular head portion 22 and a tubular tail portion 24 disposed behind the head portion 22. The rear end of the head portion 22 has the diameter smaller than that of the front end and is inserted into the front end of the tail portion 24. Between the head portion 22 and the tail portion 24 is disposed a seal member 26 for allowing the head portion 22 and the tail portion 24 to move relatively to each other in the axial direction of the shield body 12.

In the front end of the head portion 22 are provided a partition wall 30 and a diaphragm 32 defining a muck chamber 28. The partition wall 30 is spaced forward from the diaphragm 32. In the tail portion 24 is provided an annular rib 34.

The thrusting jack 14 is a pneumatic or hydraulic jack for advancing and retreating a piston rod with pneumatic or hydraulic pressure. In the embodiment shown in FIG. 3, eight jacks are disposed in the shield body 12 at equal intervals.

Figure 4:
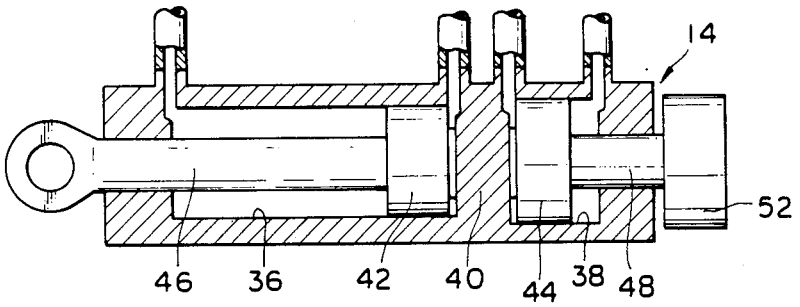
FIG. 4 is a longitudinal sectional view showing an embodiment of thrusting jack.

Each thrusting jack 14, as shown in FIG. 4, comprises a cylinder 40 including first and second cylinder chambers 36,38 having the center axes parallel to each other, a first piston 42 disposed in the first cylinder chamber 36 to be movable along said center axis, a second piston 44 disposed in the second cylinder chamber 38 to be movable along said center axis, a first piston rod 46 having one end connected to the first piston 42 and the other end projecting from the first cylinder chamber 36 in one direction of said center axis and a second piston rod 48 having one end connected to the second piston 44 and the other end projecting from the second cylinder chamber 38 in the opposite direction to said first piston rod 42.

The cylinder chamber 36, piston 42 and piston rod 46 constitute a thrusting jack section for advancing the shield body 12. The cylinder chamber 38, piston 44 and piston rod 48 constitute a direction correcting jack section for correcting the advancing direction of the shield body 12. Thus, the first cylinder chamber 36 has the axial length, i.e., the stroke of the piston, longer than that of the second cylinder chamber 38.

Each thrusting jack 14, as shown in FIG. 1, has an end of the first piston rod 46 pivotably connected to a connecting body 50 provided on the diaphragm 32 and an end of the second piston rod 48 connected to the rib 34 through a connecting body 52.

The cutter head 16 is provided with a boss 56 secured by a key 54 to an end of a rotary shaft 68 in the rotary mechanism 18, which will be later described, a face plate 58 following the front portion of the boss and a plurality of scrapers 60 extending radially from the back of the face plate.

On the central portion of the front surface of the face plate 58 are provided a plurality of center bits 62. The face plate 58 is provided with a plurality of openings arranged radially in rows in an outer periphery of said central portion. In each opening is disposed rotatably a roller bit 66. Each scraper 60 is connected to the boss 56 and the face plate 58.

Further, the face plate 58 is provided on an outer periphery of said central portion with a plurality of slits (not shown) extending radially of the face plate 58 and on both opposed side portions of the slit with cutter bits. Said roller bits 66 are used for excavating hard strata like bedrock layer. Said cutter bits are used for excavating soft strata like clay layer.

The rotary mechanism 18 is provided with said rotary shaft 68 rotatably journalled by the partition wall 30 and the diaphragm 32, a plurality of reversible motors 70, a reduction gear 72 connected to the output shaft of the motor, a gear 74 mounted on the output shaft, a large gear 76 meshing with the gear 74. The motor 70 and the reduction gear 72 are mounted on a gear case 78 fixed to the diaphragm 32. The large gear 76 is mounted on the rear end of the rotary shaft 68. In a gear case 78 is disposed a bearing 79 for preventing the rotary shaft 68 from moving axially.

Figure 3:
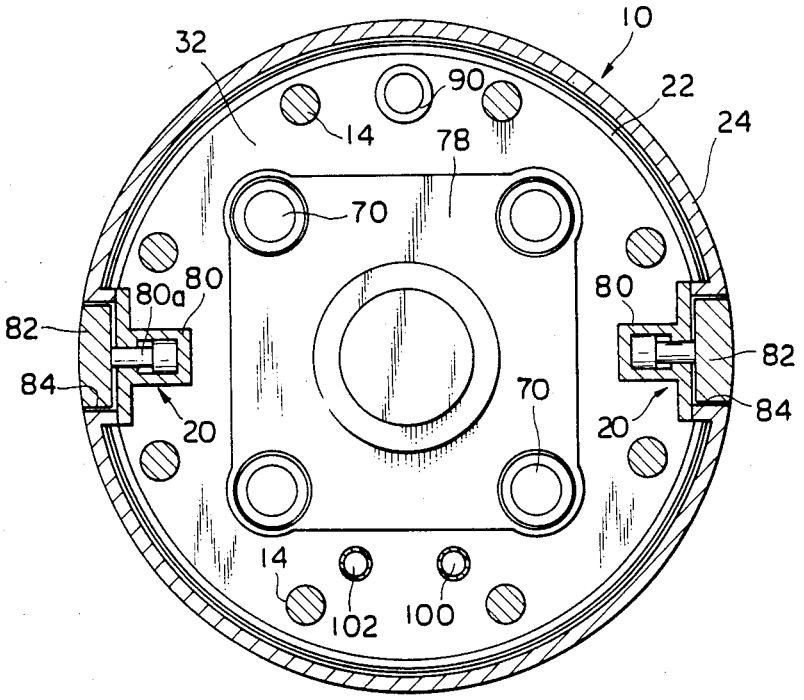
FIG. 3 is a sectional view taken along the line III—III in FIG. 1.

As shown in FIGS. 2 and 3, the position-maintaining mechanisms 20 are disposed two by two in the head and tail portions 22,24 of the shield body 12. Each position-maintaining mechanism 20 is provided with a position-maintaining jack 80 and a press body 82.

Each position-maintaining jack 80 is a jack for advancing and retreating the piston rod 80*a* with pneumatic or hydraulic pressure and secured to the shield body 12.

Each press body 82 is disposed in recesses 84 provided respectively in diametrally opposed portions of the head and tail portions 22,24 of the shield body 12 and provided on an end of the piston rod of the position-maintaining jack 80. Also, each press body 82 is located in the recess 84 when the piston rod of the position-maintaining jack 80 is retreated into the cylinder and projects more outward than an outer peripheral surface of the shield body 12 when said piston rod is projected.

The partition wall 30 is formed on an upper portion with an opening 86. In the opening 86 is disposed a lid 88 hinged to the partition wall 30. The lid 88 is connected through an arm 94 to a piston rod 92 of a cylinder 90 mounted on the diaphragm 32.

While the lid 88 normally closes the opening 86 with the cylinder 90, it is pivoted on the diaphragm 32 side against the pressure of the cylinder 90 to open the opening 86 for flowing earth and sand into the muck chamber 28 when the pressure of earth and sand received in a space between the partition wall 30 and the cutter head 16 exceeds the pressure set to the cylinder 90.

In the muck chamber 28 are disposed a rotor 96 and a stator 98 constituting a crusher for crushing relatively large conglomerate entering the muck chamber 28. The rotor 96 is mounted on the rotary shaft 68 and the stator 98 is mounted on the partition wall 30 below the rotor 96.

High pressure water is sent to the muck chamber 28 through a water supply pipe 100. Supplied water is discharged to the rear of the shield body 12 through a drain pipe 102 together with earth and sand in the muck chamber 28.

Figure 5A:
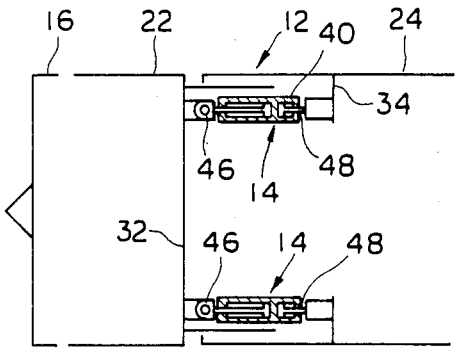
FIGS. 5(A)-5(C) are explanatory illustrations of the operation of the shield body being advanced.

In the beginning of excavation, as shown in FIG. 5(A), the piston rods 46,48 of each thrusting jack 14 is retreated into the cylinder 40.

Under this condition of the machine 10, the shield body 12 is subjected to the advancing force by each thrusting jack 14 while each motor 70 of the rotary mechanism 18 is rotated. The rotation of each motor 70 is transmitted to the face plate 58 through the reduction gear 72, gear 74, large gear 76 and rotary shaft 68 to rotate the cutter head 16. Thus, the machine 10 excavates the face while being advanced.

Excavated earth and sand enter the chamber in front of the partition wall 30 through said slits in the face plate 58 and then flow into the muck chamber 28 through the opening 86 in the partition wall 30 to be further discharged from the muck chamber 28 through the drain pipe 102 together with water. In a space formed in the rear of the shield body 12 by the advance of the shield body 12 is disposed a segment 104.

Next will be described the operation of the tunneling machine 10 being advanced.

(I) Straight advance of machine 10

First, the position-maintaining jack 80 of each position-maintaining mechanism 20 disposed in the tail portion 24 of the shield body 12 is operated, and thereby the press body 82 is pressed against the natural ground around the shield body 12. Under this condition, the piston rod 46 of each thrusting jack 14 is protected from cylinder 40. Thus, the head portion 22 of the shield body 12 is advanced relatively to the tail portion 24. Then, the segment 104 is not made a reaction body, but the natural ground around the shield body 12 is made the reaction body, so that any unreasonable force is not applied to the segment 104.

Next, the position-maintaining jack 80 of each position-maintaining mechanism 20 disposed in the head portion 22 of the shield body 12 is operated, and thereby the press body 82 is pressed against the natural ground around the body 12. Under this condition, the piston rod 46 of each thrusting jack 14 is retreated into the cylinder 40. Thus, the tail portion 24 of the shield body 12 is attracted to the head portion 22 side. Then, since the natural ground around the shield body is made the reaction body, the head portion 22 is not returned to the tail portion 24 side even if the frictional resistance between the head portion 22 and the natural ground is smaller than that between the tail portion 24 and the natural ground.

(II) Correction of advancing direction of machine 10

First, the position-maintaining jack 80 of each position-maintaining mechanism 20 disposed in the tail portion 24 is operated, and thereby the press body 82 is pressed against the natural ground around the body. Under this condition, the position rod 48 of the thrusting jack 14 located at upper portion of the shield body 12 [in the opposite direction to that of bending the excavating direction] is projected from cylinder 40. Thus, as shown in FIG. 5(B), the head portion 22 of the shield body 12 is inclined relative to the tail portion 24.

Next, the position-maintaining jack 80 of each position-maintaining mechanism 20 disposed in the tail portion 24 is operated, and thereby the head portion 22 is inclined relative to the tail portion 24. Under this condition, the piston rod 46 of each thrusting jack is projected from the cylinder 40. Thus, as shown in FIG. 5(C), the head portion 22 of the shield body 12 is advanced while inclined relative to the tail portion 24.

When the piston rod 46 of each thrusting jack 14 is full-projected, the position-maintaining jack 80 of each position-maintaining mechanism 20 disposed in the head portion 22 is operated in place of the position-maintaining jack 80 of each position-maintaining mechanism 20 disposed in the tail portion 24 to retreat the piston rod 46 of each thrusting jack 14 into the cylinder 40 with the press body 82 being pressed against the natural ground around the shield body 12.

Figure 5B:
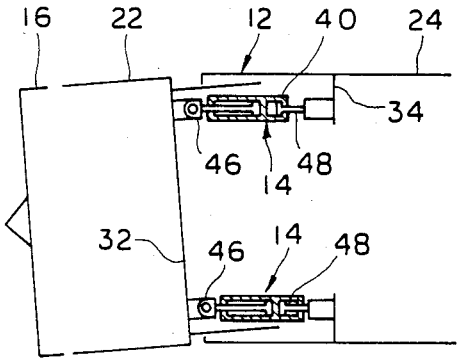
Figure 5C:
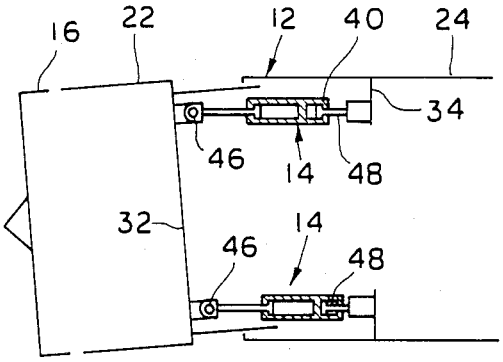

Thus, while the tail portion 24 is attracted to the head portion 22 side, the head portion 22 is maintained inclined relative to the tail portion 24 as shown in FIG. 5(B). Thus, the shield body 12 is advanced along a curved path by the repetition of said processes.

(III) Straight readvance of shield body 12

The processes of said (I) will do after the piston rod 48 projecting from the cylinder 40 is retreated into the cylinder with each position-maintaining mechanism 20 disposed in the head portion 22 being operated.

What is claimed is:

1. A shield tunneling machine comprising:

a shield body provided with a tubular head portion and a tubular tail portion disposed behind the head portion;

a plurality of thrusting jacks for interconnecting said head portion and tail portion and moving said head portion and tail portion to and away from each other;

a cutter head disposed in front of said shield body;

a rotary mechanism for rotating the cutter head; and a plurality of position-maintaining mechanisms disposed in said shield body and each having a press body capable of projecting outward of the shield body, each of said thrusting jacks include a cylinder having first and second cylinder chambers, a first piston disposed in said first cylinder chamber and movable axially in the direction of said first cylinder chamber, a second piston disposed in said second cylinder chamber and movable axially in the direction of said second cylinder chamber, a first piston rod having one end connected to said first piston and the other end projecting axially in one direction from the first cylinder chamber and a second piston rod having one end connected to said second piston and the other end projecting from said second cylinder chamber in the opposite direction to said first piston rod.

2. A shield tunneling machine as claimed in claim 1, wherein the center axes of said first and second cylinder chambers are located on the same straight line.

3. A shield tunneling machine as claimed in claim 1, wherein the length in the direction of the center axis of said first cylinder chamber is greater than that of said second cylinder chamber.

4. A shield tunneling machine as claimed in claim 1, wherein one of said first and second piston rods is connected with one of said head portion and tail portion and the other, with the other.

* * * * *